US008337120B2

(12) United States Patent
Li

(10) Patent No.: US 8,337,120 B2
(45) Date of Patent: Dec. 25, 2012

(54) DEFORMABLE ROCK BOLT

(75) Inventor: Charlie Chunlin Li, Trondheim (NO)

(73) Assignee: Dynamic Rock Support AS, Trondheim (NO)

( * ) Notice: Subject to any disclaimer, the term of this patent is extended or adjusted under 35 U.S.C. 154(b) by 353 days.

(21) Appl. No.: 12/520,791

(22) PCT Filed: Dec. 21, 2007

(86) PCT No.: PCT/NO2007/000461

§ 371 (c)(1),
(2), (4) Date: Sep. 14, 2009

(87) PCT Pub. No.: WO2008/079021

PCT Pub. Date: Jul. 3, 2008

(65) Prior Publication Data

US 2010/0021245 A1 Jan. 28, 2010

(30) Foreign Application Priority Data

Dec. 22, 2006 (SE) ..... 0602799

(51) Int. Cl.
*E21D 21/00* (2006.01)

(52) U.S. Cl. ..... 405/259.5; 405/288

(58) Field of Classification Search ..... 405/258.1, 405/259.1, 259.4, 259.5, 259.6, 288
See application file for complete search history.

(56) References Cited

U.S. PATENT DOCUMENTS 3,394,527 A * 7/1968 Chalmers ..... 52/741.1
4,129,007 A * 12/1978 Rausch ..... 405/259.6
4,360,292 A * 11/1982 Keeler et al. ..... 405/244
4,784,530 A 11/1988 Price, Jr.
4,938,631 A * 7/1990 Maechtle et al. ..... 522/35
5,259,703 A 11/1993 Gillespie
5,273,377 A * 12/1993 Taylor ..... 405/259.6
5,511,909 A 4/1996 Calandra, Jr. et al.
5,919,006 A * 7/1999 Calandra et al. ..... 405/302.2
7,037,046 B2 * 5/2006 Fergusson ..... 405/259.5
2004/0136789 A1 * 7/2004 Fergusson ..... 405/259.5
2005/0134104 A1 * 6/2005 Simmons et al. ..... 299/31

(Continued)

FOREIGN PATENT DOCUMENTS

AU 2003204831 A1 1/2004

(Continued)

OTHER PUBLICATIONS

Bjornfot and Stephansson, "Mechanics of Grouted Rock Bolts—Field testing in hard rock mining," Swedish Rock Engineering Research Foundation—BeFo, 53:1/84, 1984.

(Continued)

*Primary Examiner* — Tara Mayo-Pinnock
(74) *Attorney, Agent, or Firm* — Birch, Stewart, Kolasch & Birch, LLP

(57) ABSTRACT

A rock bolt for being grouted in a borehole, —includes an elongate cylindrical massive stem (1) with extensive lengths of stem portions (1*s*) separated by integrated anchors (2). The anchors are distributed with separations along the length of the stem (1). The anchors (2) are locally anchored relative to their local borehole wall portions for taking up load arising due to rock deformation. The stem portions (1*s*) are arranged for slipping relative to the grout or the borehole so as for each of the stems (1*s*) to take up local elongation strain between pairs of locally anchored preceding and consecutive anchors.

19 Claims, 10 Drawing Sheets

U.S. PATENT DOCUMENTS

| | | | |
|---|---|---|---|
| 2005/0158127 | A1 | 7/2005 | Fergusson |

FOREIGN PATENT DOCUMENTS

| | | | |
|---|---|---|---|
| DE | 35 04 543 | C1 | 5/1986 |
| DE | 101 31 818 | C1 | 2/2003 |
| JP | 2006-299546 | A | 11/2006 |
| WO | WO-99/61749 | A1 | 12/1999 |
| WO | WO 2005/012691 | A1 | 2/2005 |

OTHER PUBLICATIONS

Li and Stillborg, "Analytical models for rock bolts," International Journal of Rock Mechanics and Mining Sciences, vol. 36, No. 8, 1999, pp. 1013-1029.

Li, "A practical problem with threaded rebar bolts in reinforcing largely deformed rock masses," Rock Mechanics and Rock Engineering, vol. 45, No. 5, pp. 519-524, Jun. 2006.

Li, "Field tests of the cone bolt in mines of Boliden," Bergmekanikkdagen, 2004, pp. 1-12.

Li, "Rock support design based on the concept of pressure arch," International Jorunal of Rock Mechanics and Mining Sciences, vol. 47, No. 7, 2006, pp. 1083-1090.

Stillborg, "Professional Users Handbook for Rock Bolting," Trans Tech Publications, 2nd ed., 1994.

Sun, "Grouted rock bolt used in underground engineering in soft surrounding rock or in highly stressed regions," Proceedings of the International Symposium on Rock Bolting, 1984, pp. 93-99.

Matthews et al., "A Modified Cable Bolt System for the Support of Underground Openings," The Aus I.M.M. Conference, pp. 243-255, Jul. 1983.

Norweigian Directorate of Public Roads, "Handbook 215 for Rock Bolting," Statens vegvesen, Guidelines, pp. 1-36, 1999, with partial translation.

* cited by examiner

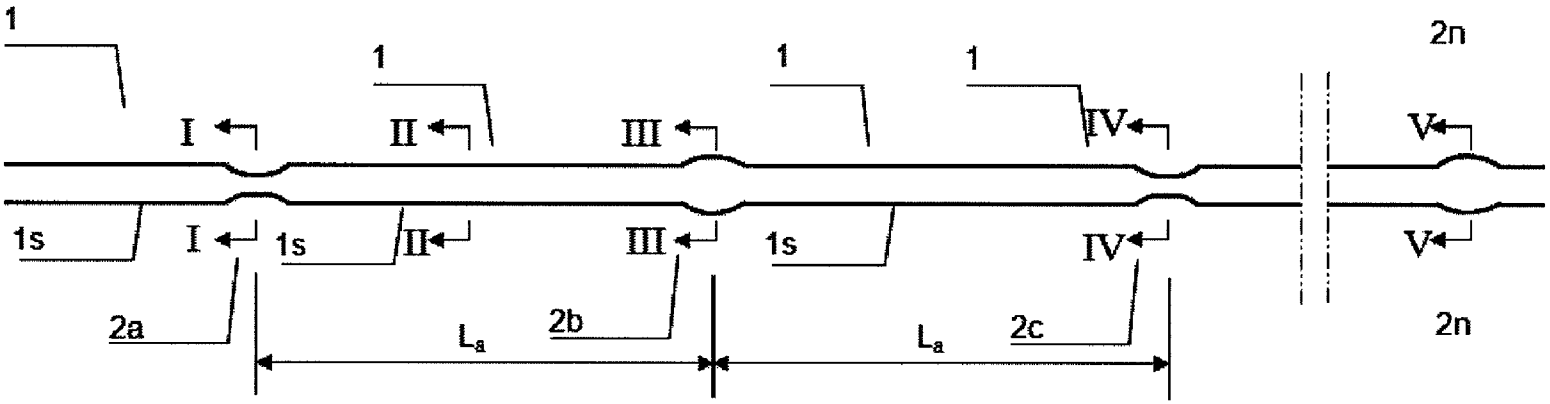
Fig. 1a
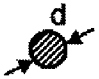
Fig. 1b
Fig. 1c
Fig. 1d
Fig. 1e
Fig. 1f

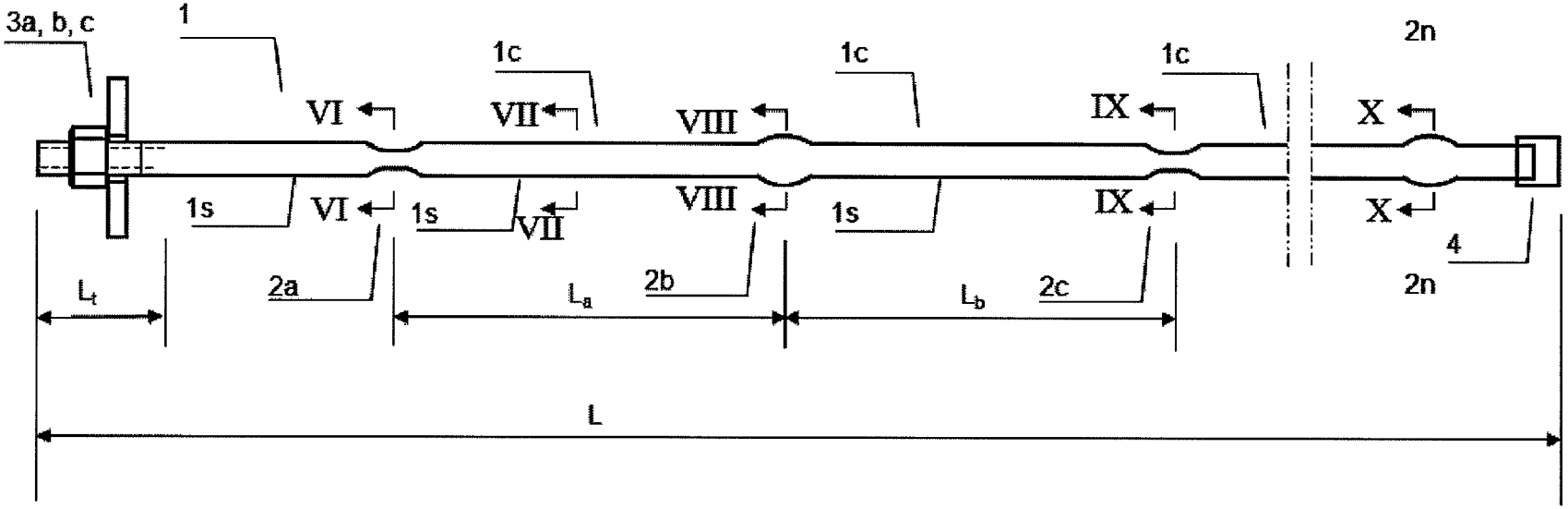
Fig. 3a
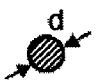
Fig. 3b
Fig. 3c
Fig. 3d
Fig. 3e
Fig. 3f

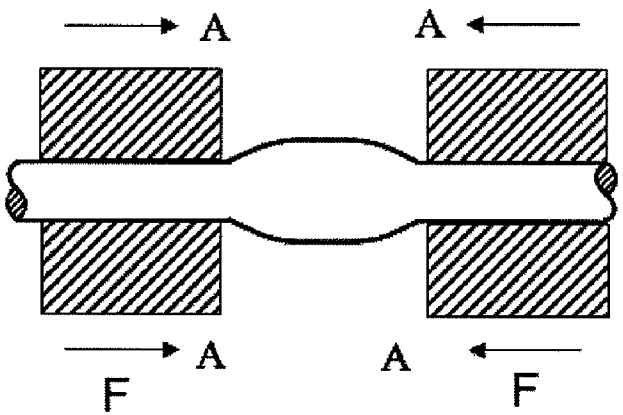
Fig. 5b(1)
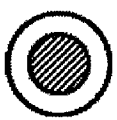
Fig. 5b(2)
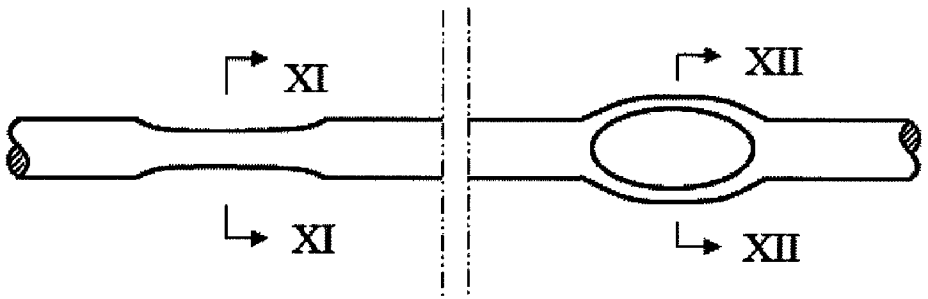
Fig. 5a(1)
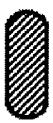
Fig. 5a(3)
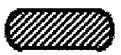
Fig. 5a(2)

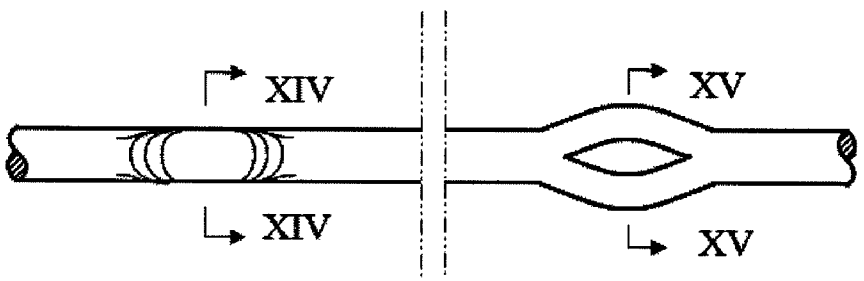
Fig. 5d(1)
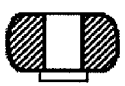
Fig. 5d(2)
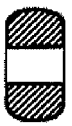
Fig. 5d(3)
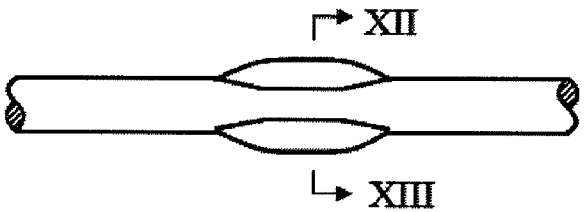
Fig. 5c(1)
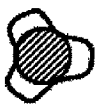
Fig. 5c(2)

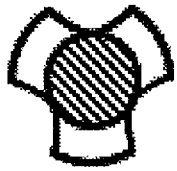
Fig. 5e(2)
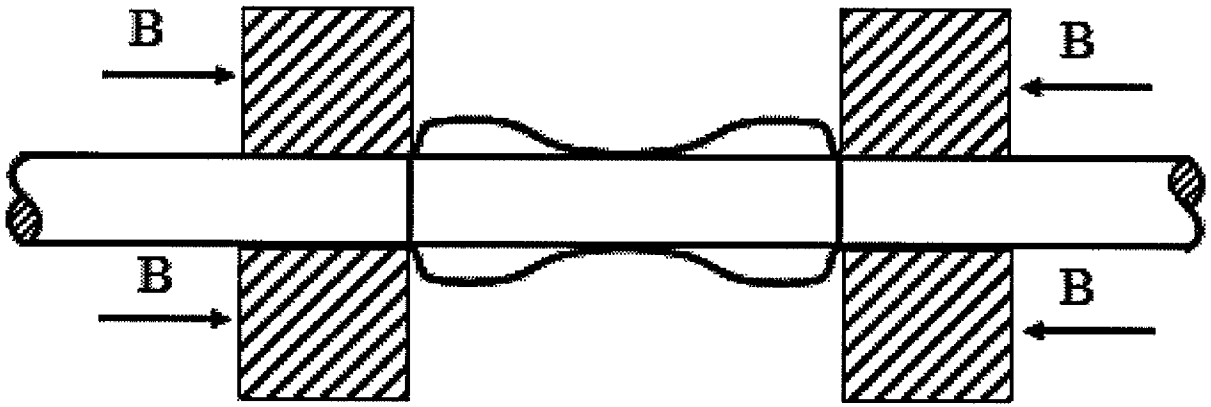
Fig. 5e(1)

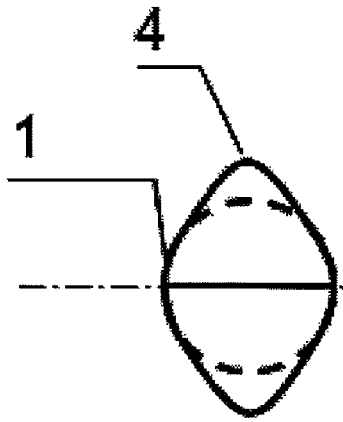
Fig. 6a(2)
(background art)
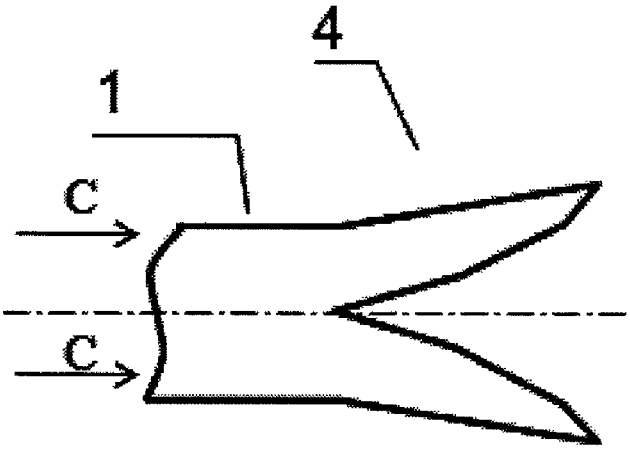
Fig. 6a(1)
(background art)
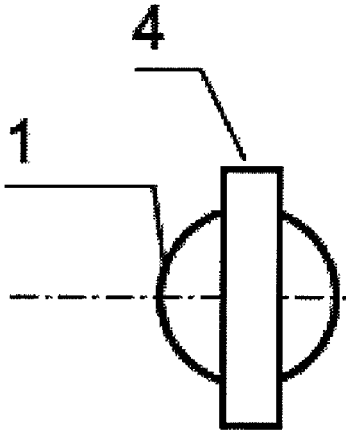
Fig. 6b(2)
(background art)
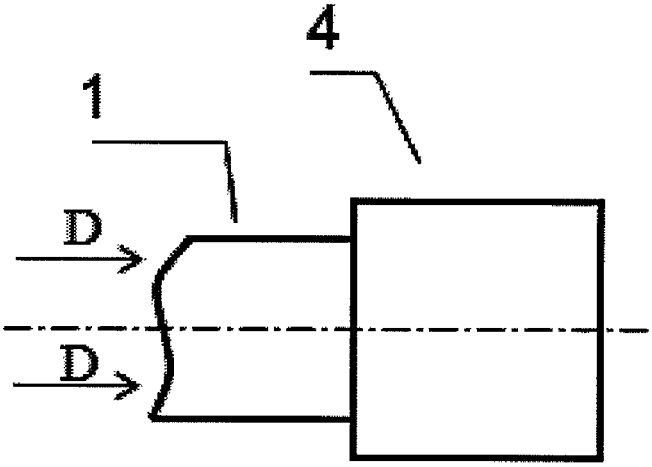
Fig. 6b(1)
(background art)

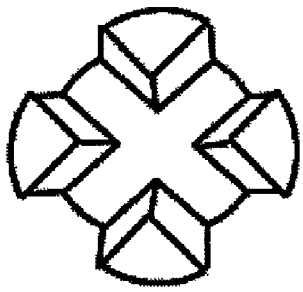
Fig. 10a(1)
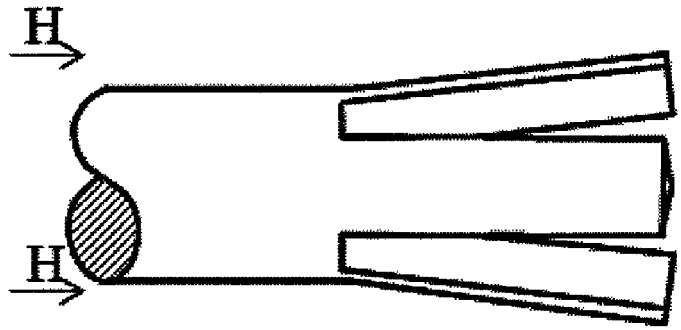
Fig. 10a(2)
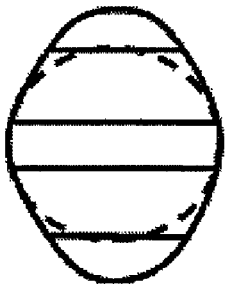
Fig. 10b(1)
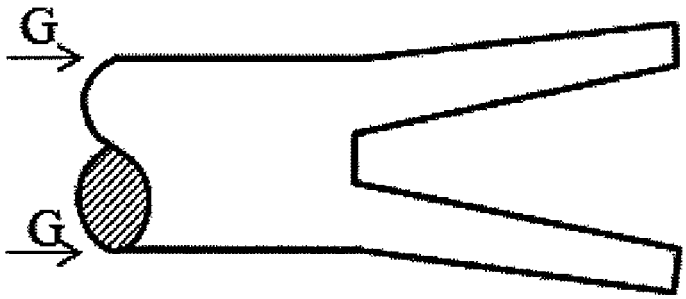
Fig. 10b(2)

DEFORMABLE ROCK BOLT

INTRODUCTION

This invention relates to bolting for reinforcement of rocks subject to slow deformation or sudden bursting. Bolting is the most commonly used measure for rock reinforcement in underground excavations. Millions of rock bolts are consumed in the world every year. Basic demands to rock bolts are that they have to be able to bear not only a heavy load, but also withstand a certain elongation before failure of the bolt. In highly-stressed rock masses, the rock reacts to excavation either in form of large deformation in weak rocks, or of rock bursting in hard rocks. In these situations, deformation-tolerable (or energy-absorbable) bolts are required in order to achieve a good effect of rock reinforcement. Particularly in the mining industry, this need for deformation-tolerable bolts is even stronger than in other rock branches since mining activities are getting deeper and deeper and problems of rock deformation and rock burst become increasingly severe.

BACKGROUND ART

WO99/61749 Ferguson: "Rock bolt and method of forming a rock bolt" describes indentations forming paddle sections formed by plastically deforming a portion of a steel bar, the deformation made through application of an eccentric shear force on the bar, resulting in paddles such as redrawn in FIG. 8 of the present application. The purposes of Ferguson's rock bolt is for the paddle to enhance mixing, and for the shear formation of the paddle not to plastically deform the bolt axially nor sidewardly of the bolt. Ferguson proposes an expandable shell mounted including radially acting wedges for interacting with the paddles to expand the shells to lock the bolt against the wall of the bolt hole. Ferguson further proposes a plurality of paddle sections formed along the extent of the bolt. A significant disadvantage of the paddles of Ferguson is that the fabricating method involving deforming a portion of the bolt by application of an eccentric shear force, makes the paddle section to constitute the weakest point so that it could not provide a satisfactory anchoring effect.

US-patent application 2005/0158127A1 also to Ferguson, "Yielding strata bolt", describes a rock bolt having a tendon which may yield by slipping through the anchors rather than by yield of the tendon material, and thereby control movement of unstable rocks into which the bolt is arranged. The tendon as such may be constituted by strands of wire or a metal bar, and has a surrounding tube arranged as a grout slippage mechanism. The grout anchors are constituted by two symmetrical anchor parts clamped to the tendon, please see FIG. 9 of the present application. A disadvantage of US2005/0158127 is the fact that the tension element is only deformed and not strengthened compared to the straight portion of same, and thus the bolt is susceptible to break at the anchor, particularly if the tension element is made of a solid bar. Another disadvantage of US2005/0158127 is the mere number of components required for forming a functioning rock bolt.

German patent DE 35 04 543 defines an anchor rod for being inserted and grouted or glued into boreholes in subsurface cavities. The anchor has an anchor rod with sections having a profiled surface for connection with the rock and a single-ended threaded portion with a nut integral with or welded to the rod itself. The anchor rod has a fixed, integral or welded anchor plate separating between the external threaded portion and the borehole-internal partially profiled portion of the anchor rod and may thus not be used for pre-tensioning the anchor rod in the borehole. A surface profiling of the anchor rod is formed through a wave formation in the longitudinal direction of an originally smooth rod with a round cross-section. The rod of DE 35 04 543 has three consecutive sections for sitting in a borehole: a smooth, projection-free middle portion of the anchor rod with a transition to a wavy portion of the rod in either ends of the smooth middle section, the transition having an increasing wave amplitude in the direction away from the smooth middle section. The smooth portion is for taking up longitudinal forces arising after rock deformation has occurred, but may not prevent initial rock deformation due to the fact that the rock bolt may not be pre-tensioned in the borehole.

PROBLEMS TO BE SOLVED

In accordance to the anchoring mechanism all bolting devices are classified in three categories: (a) mechanical bolts, (b) fully grouted bolts and (c) frictional bolts.

(a): Conventional mechanical bolts are two-point anchored in open holes. They are not reliable in case of large rock deformation.

(b): Fully grouted bolts mainly refer to rebar bolts grouted in holes with either cement or epoxy resin. A rebar bolt is made of a steel bar with ribs on its cylindrical surface. This type of bolt is stiff and tolerates only small deformations prior to failure. It has often been observed that rebar bolts fail in highly stressed rock masses (Li, 2006a).

(c): Frictional bolts can bear a large deformation, but their load-bearing capacity may be quite low. For instance, a standard Split Set bolt may only bear a load of about 50 kN (Stillborg, 1994).

Among all the alternatives of the presently available commercial rock bolts, the bolt best suitable for combating problems of rock deformation and rock burst may be the so-called South African cone bolt (Li and Marklund, 2004). The cone bolt can elongate largely and at the same time it bears a quite high load. However, it is a two-point-anchored bolt with an inverted cone at the inner end of an otherwise slick bolt for being installed in a cement-filled hole. The surface anchor may be a plate held by a nut on the threaded outer end of the bolt. A failure of one of the anchors, for instance at the wall surface, would lead to a complete loss of its function of rock reinforcement.

Concerning rock reinforcement in highly stressed rock masses, the drawbacks of the currently available bolts are:

- Rebar bolts are too stiff and tolerate a very limited elongation (about 10 mm) prior to failure.
- Frictional bolts provide a too low load-bearing capacity.
- Cone bolts are not sufficiently reliable because of their two-point anchoring mechanism.

Loading Patterns of Bolts in Different Rock Masses

In weak rocks, a large volume of rock around an underground opening will be subjected to failure in the case of high in-situ stresses. The magnitude of rock deformation is largest at the wall surface of the opening and decreases towards the inside of the rock mass. This type of rock deformation results in that the rock bolts are most severely loaded in the area close to the wall surface (Sun, 1984; Li and Stillborg, 1999). That explains why many rebar bolts fail at the thread in largely deformed rock masses (Li, 2006a). Sometimes, even a large shear fracture may be developed several metres back of the wall surface (Li, 2006b). In this case, it is demanded that the bolts should possess also capability of bearing load and deformation in deep locations.

In a jointed rock mass, a bolt is locally loaded at locations where the bolt intersects rock joints which are being opened (Björnfot and Stephansson, 1984). There may exist several load peaks along the length of a bolt and the most loaded bolt section may be situated deeply inside the rock. In this type of rock mass, it is demanded that the bolt has a good load bearing capacity and also a high deformation bearing capacity along its entire length.

Desired Characteristics for an Ideal Bolt

An ideal bolt for largely deformed rock mass should be able to bear a large load as well as being able to take a long elongation. Furthermore, the anchoring mechanism of the bolt should be reliable.

SHORT SUMMARY OF THE INVENTION

The above problems may be solved by the present invention which is a rock bolt for being grouted in a borehole in a rock, said rock bolt characterised by an elongate cylindrical massive stem with a threaded portion at the borehole surface portion of said stem, said threaded portion provided with one or more nuts and one or more washers, sheaves or face plates arranged for pre-tensioning the rock bolt in the borehole;

said stem comprising three or more extensive lengths of stem portions, each stem portion followed by an integrated anchor, said anchors being of short extent compared to the extent of said stem portions, said anchors distributed with separations along the length of said stem;

said anchors for being locally anchored relative to their corresponding local borehole wall portions for taking up load arising due to rock deformation, said stem portions arranged for slipping relative to the grout or the borehole, so as for each of said stems to constraining local rock deformation through elongation of said stem portions between pairs of a locally anchored preceding anchor and a locally anchored consecutive anchor.

ADVANTAGES OF THE INVENTION

The present invention has certain advantages over WO99/61749 in that the anchors of the present invention constitute not the weakest but the strongest elements of the rock bolt so that they are not susceptible of deforming or breaking under load, and may thus provide a satisfactory anchoring effect.

The present invention also provides advantages over US-patent application 2005/0158127A1 in the fact that the tension element is reworked to form strengthened anchors compared to the straight portions of the rock bolt stem, and thus the bolt is susceptible to yield along the stem portions and not at the anchors. Another advantage over US2005/0158127 is the significant reduction of components (at least 6 components) required for forming a functioning rock bolt, in the simplest embodiment formed by an elongate steel stem with integrated anchors formed from the same blank.

DESCRIPTIONS OF THE DRAWINGS

The invention has been illustrated in the attached drawings, which are intended to illustrate the invention and which shall not be construed to limit the invention, which shall only be limited by the attached claims only.

FIG. 1, including FIGS. 1*a*-1*f*, is a side elevation view of a rock bolt according to the invention, here illustrated in a basic embodiment comprising only a stem with evenly distributed integrated anchor portions for being anchored to the cement or resin when hardened in a borehole.

FIG. 2 is a side elevation view of a rock bolt according to the invention, here illustrated arranged in a section of a borehole with the integrated anchor portions anchored by grout hardened to cement or alternatively resin. For simplicity only the grout adjacent to the anchors is illustrated. A stem portion is illustrated spanning a crack that has opened between two blocks of the rock, and the stem portion has been extended while the adjacent anchors remain fixed relative to their local borehole perimeters.

FIG. 3, including FIGS. 3*a*-3*f*, is a side elevation view of a rock bolt according to an embodiment of the invention, here illustrated with a threaded portion with a washer and/or a face plate and a nut at the left side of the drawing, and further illustrated with an optional end mixer at the right side of the drawing.

FIG. 4 is a side elevation view of a rock bolt according to an embodiment of the invention, here arranged grouted between the bottom of the hole and a washer at the surface of the rock. Only the portions of the grout about the anchors are illustrated for simplicity, and the entire annulus about the bolt would normally grout-filled.

FIGS. 5*a*-5*e* illustrate different embodiments of the anchors according to the invention. FIG. 5*a*, including FIGS. 5*a*(1)-5*a*(3), illustrates an embodiment of the anchor in which a short portion of the stem has been flattened to provide a widened, integrated anchor. The flattening may take place under slight longitudinal simultaneous upsetting so as for providing a yield strength of said anchors higher than the yield strength of the adjacent stem portions. FIG. 5*b*, including FIGS. 5*b*(1)-5*b*(2), illustrates another embodiment of the anchor in which a short portion of the stem has been shortened by longitudinal upsetting. FIG. 5*c*, including FIGS. 5*c*(1)-5*c*(2), is an illustration of a three-lobed anchor that shows a certain tapering-off in the transition zone toward either end. FIG. 5*d*, including FIGS. 5*d*(1)-5*d*(3), illustrates a rock bolt according to the invention having anchors with an eye-shaped aperture. FIG. 5*e*, including FIGS. 5*e*(1)-5*e*(2), illustrates an embodiment of an anchor shaped by upsetting similar to the upsetting of FIG. 5*b*.

FIG. 6, including FIGS. 6*a* and 6*b*, shows two alternative forms of background art end mixers which may optionally be arranged at the bottomhole end of the rock bolt of the invention. FIG. 6*a*, including FIGS. 6*a*(1)-6*a*(2), shows an Y-split end mixer and FIG. 6*b*, including FIGS. 6*b*(1)-6*b*(2), shows an end mixer plate welded to the bottomhole end of the bar.

FIG. 10, including FIGS. 10*a*(1), 10*a*(2), 10*b*(1) and 10*b*(2), shows two embodiments of end mixers.

DESCRIPTION OF EMBODIMENTS OF THE INVENTION

The rock bolt according to the invention approaches a bolt providing the required qualities of an ideal bolt mentioned above. It is given a name of a deformable bolt, abbreviated to "D-bolt". The deformable bolt according to the invention is a multi-point anchored bolt arranged for being grouted with either cement or epoxy resin in a borehole. FIG. 1 shows the side elevation view of the bolt according to a basic embodiment of the invention, comprising a preferably smooth steel rod stem (1) with three or more integrated anchors (2*a*, 2*b*, 2*c*, . . . , 2*n*) distributed along the length of the rod stem. Stated in other terms, the invention comprises a rock bolt for being grouted by grout (g) in a borehole (b), the rock bolt comprising an elongate cylindrical massive stem (1) comprising extensive lengths of stem portions (1*s*) separated by integrated anchors (2) distributed with separations ($L_a$) along the length of said stem (1). The anchors (2*a*) are arranged for being locally anchored relative to their local borehole wall portions for taking up load arising due to rock deformation. The stem portions (1*s*) are arranged for slipping relative to the grout or the borehole, so as for each of said stems (1*s*) to take up local elongation strain between pairs of a locally anchored preceding anchor (2) and a locally anchored consecutive anchor (2).

The rock bolt of the invention comprising the stem (1) with integrated anchors (2) is advantageously all made in steel. Other metals that are both strong and deformable may be used.

According to a first application of the rock bolt according to the invention, the stem portions (1*s*) are adapted for taking up local elongation strain due to long-term rock deformation that may take place during days, months, or years after excavation such as would occur in weak, soft rocks.

Figure 2:
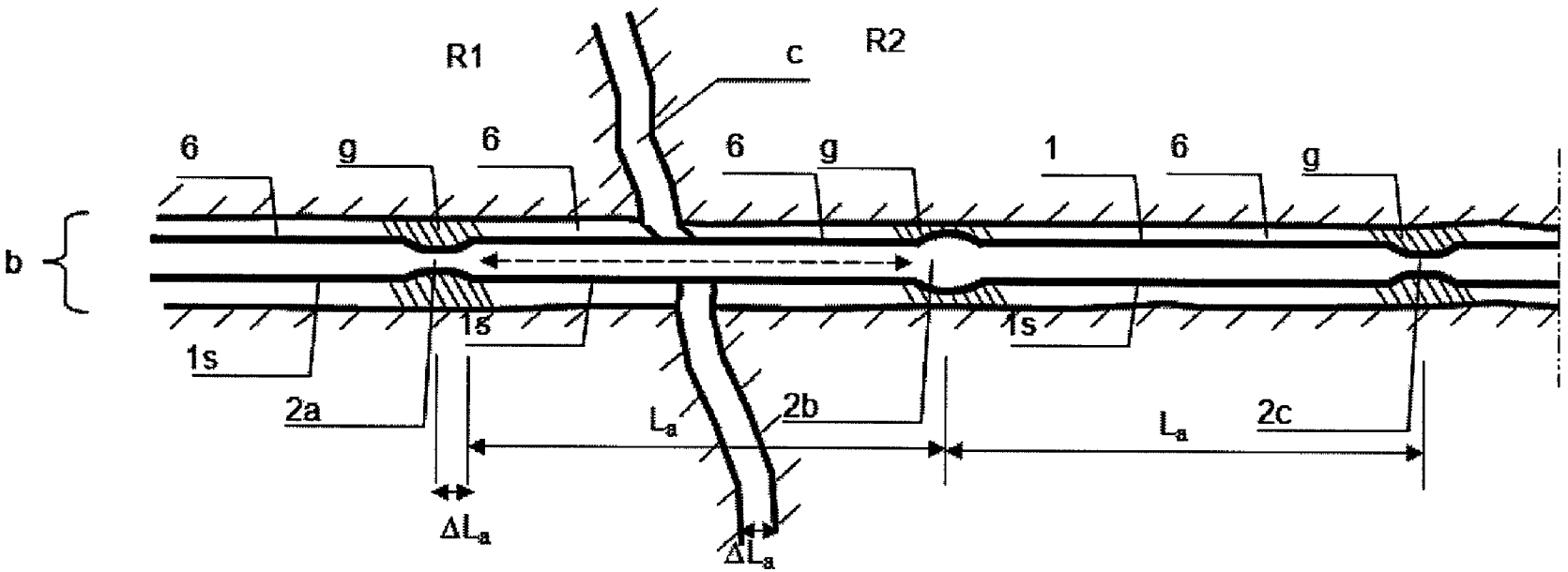
Figure 4:
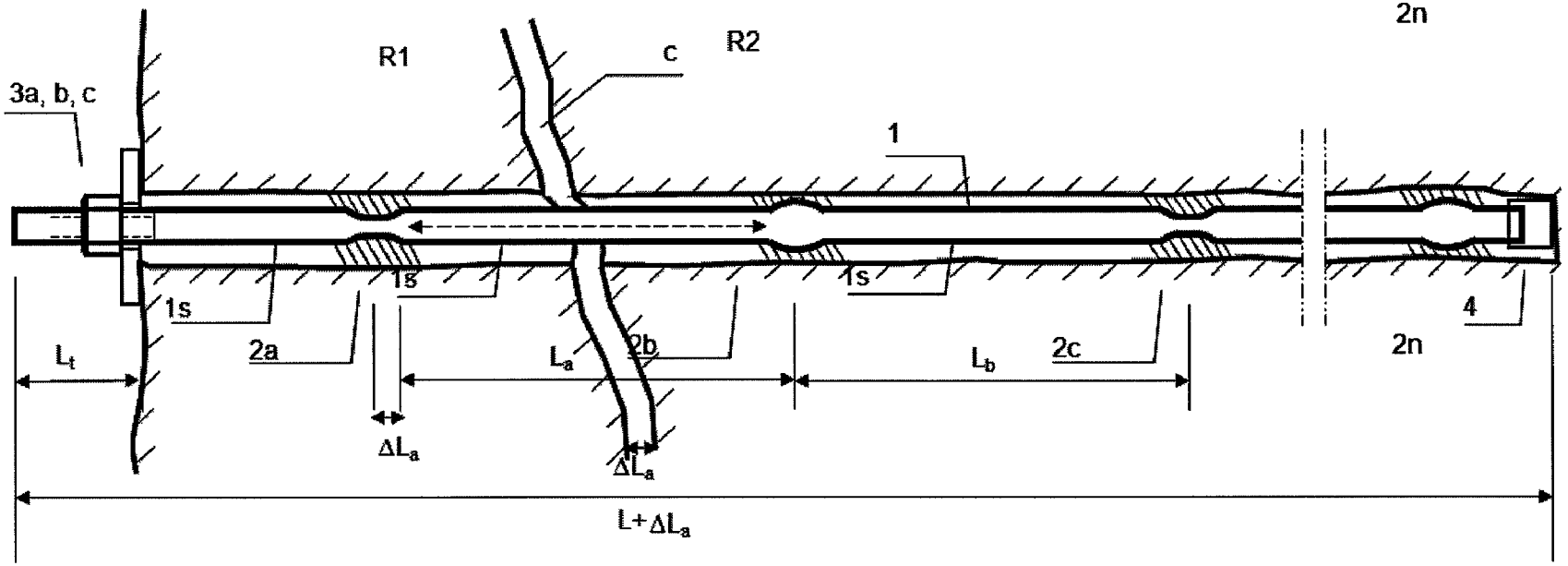
Figure 8:
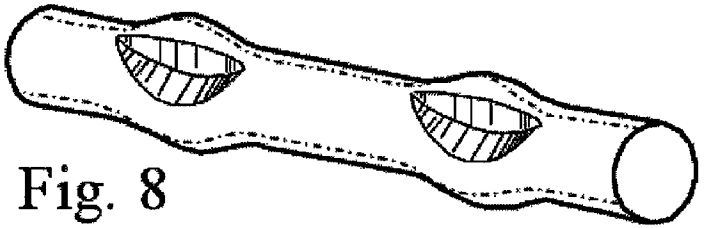
Fig. 8 (background art)
FIG. 8 is an isometric view redrawn from WO99/61749 Ferguson showing indentations forming paddle sections formed by deforming a portion of a steel bar, the deformation made through application of a mechanical eccentric shear force on the bar.
Figure 9:
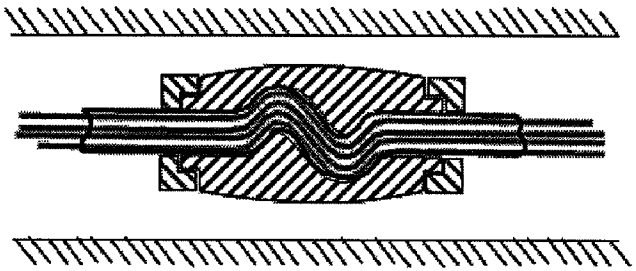
Fig. 9 (background art)
FIG. 9 is a longitudinal section view redrawn from US2005/0158127, also to Ferguson, showing a tensioning element or tensioning wires in a pipe deformed by a two-part clamping anchor.
Figure 7:
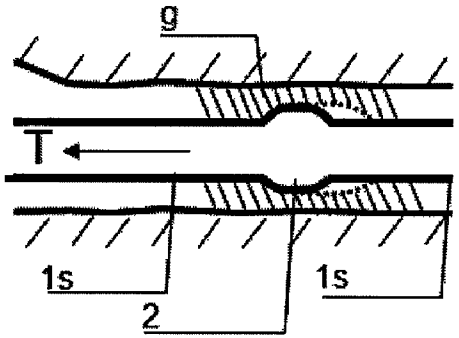
FIG. 7 illustrates that whereas the main portion of deformation shall be absorbed in elongating the stem portion between the anchors, a proportion of the deformation may also be taken up as a relatively short longitudinal slide movement of an anchor in the hardened grout.

According to a second application of the rock bolt according to the invention, the stem portions (1*s*) may take up short-term dynamic loads such as dynamic loads due to rock bursts or explosions. This is due to the fact that a local elongation of the rock bolt due to a suddenly bursting crack indicated by "c" in FIGS. 2 and 4, which opens to separate disjoint crack surfaces by several centimeters may be distributed over about 50 centimeters of steel if using a rock bolt according to the invention. The stem portions between the anchors will only slide relative to the hardened grout or the borehole perimeter. This effect may not be achieved using a rebar rock bolt of which every portion is ribbed and thus locally stuck almost over every stem section in the grout, and which may be forced to take up a local shock elongation ($\Delta L_a$) over only a few centimeters, and thus break, which is often experienced in the background art. In this way, also dynamic loads similar to rock bursts, such as explosions, may be taken up without the rock bolt breaking.

In an embodiment of the invention, the bolt shall comprise a threaded portion (3*a*) arranged in the head end and provided by a nut (3*b*) for holding a washer (3*c*) or plate against a rock surface. According to an embodiment, the opposite end for constituting the inner end of the rock bolt with regard to the borehole may be provided with an end mixer (4) which will be useful when inserting the rock bolt into epoxy resin.

The spacing between two adjacent anchors is here denominated $L_a$ and may be even. The length of a bolt is thus in an embodiment approximately $L=n\,L_a$, where n is the number of the rod segments between anchors (or the number of the anchors). A non-even distribution of anchors along a portion of the stem may also be used.

Advantageously, in the rock bolt of the invention the stem portions (1*s*) are arranged for having a higher deformation capacity per unit length as compared to the anchors (2). Further, in the rock bolt of the invention, the integrated anchors (2) may advantageously be hardened so as to prevent being deformed while being loaded while fixed in the hardened grout, and to prevent being ground down if sliding in the hardened grout. Stated otherwise, the ultimate strength of the anchors (2) should be higher than the yield strength of the stem constituted by the stem portions (1, 1*s*).

The stem portions (1*s*) are arranged for slipping relative to the hardened grout or the borehole, so as for each of said stems (1*s*) to take up local elongation strain between pairs of a locally anchored preceding anchor (2) and a locally anchored consecutive anchor (2). The rod stem (1) of the bolt has, according to an embodiment of the invention, a smooth, preferably cylindrical surface. The stem portions may be more or less finely ground or polished by techniques like chemical polishing or electropolishing. The surface may further be treated in such a way that the surface of the rod has no or negligibly low bonding to the hardened grout. One means to achieve this goal is to coat the rod surface with a thin layer of wax, lacquer, paint or other non-adhesive or lubricant medium. When subjected to tensile loading, rod segments between two adjacent anchors would more or less freely elongate without coupling to the hardened grout around.

When elongating under strain, the stem (1) may slip relative to its local borehole perimeter by having a surface released relative to said hardened grout due to diameter reduction due to the so-called Poisson effect.

The rock bolt according to the invention may have the stem portions (1*s*) being surface treated so as for not binding to said hardened grout. This may be achieved through chemical surface treatment such as by being added a metal oxide layer on the stem (1).

At the anchoring points the bolt is coupled to the rock mass. A basic demand to the anchors is that they are stronger than the rod. It implies that the rod gets into yielding before the anchors fail. The anchors can have different shapes. The shape of the anchor shown in FIG. 1 shows just one of several useful shapes of anchors. With the embodiment shown, the anchor is formed simply by flattening the rod in one diameter-direction and enlarging the dimension in the orthogonal direction. The neighbour anchors may have the same flattened shape made orthogonally to the flattening direction of the present anchor. Advantageously, given that the borehole is more or less straight and having an even wall, the evenly spaced anchors may make the steel rod avoid direct contact with the wall of the borehole, which may help the bolt being entirely enveloped by the grout. This may provide an improved corrosion protection of the bolt stem as compared to conventional bolts having only a bottom anchor and a surface anchor.

It is known in the background art that for resin grouting, a mixing mechanism, called end mixer, may be added to the bottom end of the bolt, please see FIG. 6. One alternative for the end mixer is to split the rod end into a shape of "Y", please refer to FIG. 6*a*. Other alternatives, such as a blade welded to the end, please see FIG. 6*b*, are also possible for the end mixer. FIG. 10 shows two embodiments of end mixers useful for use in boreholes with epoxy resin.

A rock bolt according to the invention may reinforce the rock in a way as explained below: Rock deformation will primarily load the bolt according to the invention via the anchors. The rod, i.e. the bolt stem portions between two adjacent anchors, in turn, will be stretched and elongated. Under extremely high loads, the rod will get into yielding. In some cases, for instance a relatively weak grout, the anchors could even slide a bit within the grout without a significant loss of reinforcement. Because of these two mechanisms, the bolt can tolerate a large elongation, while at the same time it bears a high load. In fact, this bolt according to the invention to a large extent utilises the capacity of the steel material in both its deformation capacity and strength. The rock anchoring effect of the bolt is assured within segments between the anchors. A loss of anchoring at an individual anchor only locally affects the reinforcement effect of the bolt. In the whole the bolt would still work well with a loss of one or more individual anchors, as long as one or more anchors are fixed in the borehole. Assume that, for instance, the thread portion of the bolt according to the invention fails and the anchoring at the surface is lost. With the two-point anchor bolts according to background art such a loss of surface anchoring incurs a total failure of the bolt, whereas the result of a surface anchor failure with the bolt of the invention is a loss of reinforcement only in the bolt segment between the thread and the first anchor being closest to the surface. The remainder of the bolt is not affected by the surface segment failure of the thread because it is still well anchored in the rock by the remaining unaffected anchors.

The thread should be at least as strong as the steel rod or even stronger. Therefore, the nominal diameter of the thread should be larger than the diameter of the rod so as for the effective diameter of the thread to be equal to or larger than the diameter of the rod. Another embodiment of the invention is to conduct special metallurgical treatment to the thread portion so that its strength is made higher than the rod. The deformation capacity of the thread is not particularly relevant. The main issue about the thread is that the thread is made so strong that the steel rod between the thread and the first anchor has a chance to get into yielding. If done so, the ultimate deformation prior to failure of the rod would be significantly large.

An example of a rock bolt according to the invention is presented below and illustrated in FIG. 3 It is assumed that the parameters of the bolt are given as follows.

| | |
|---|---|
| Rod diameter, d: | 20 mm |
| Anchor spacing, $L_s$: | 0.55 m |
| Anchor length, $L_a$:: | 0.05 m |
| Thread length, $L_t$: | 0.10 m |
| Number of anchors, n: | 5 |
| Bolt length, L: | 5 × 0.55 = 2.75 m. |
| Bolt fracture strength: | 200 kN |
| Bolt yielding strength: | 150 kN |
| Yielding strain at failure: | 20% |

The bolt of the example has 5 bolt segments with every segment being $(L_s-L_a)$=0.5 m long. Taking into account the yielding elongation, every segment can extend up to (0.5 m×20%)=10 cm. Thus each rod segment (0.5 m long) can bear a maximum elongation of 10 cm. At the same time it bears a load between 150 and 200 KN. The first segment of the rod (from the thread to the first anchor) may be a bit shorter than the others. In the example embodiment it is about 0.4 m $(L_s-L_a-L_t)$). The ultimate elongation of this segment is (0.4 m×20%)=8 cm. For rebar bolts, it is only the deformation capacity of the part of the thread is motivated (Li, 2006a). The ultimate elongation from the tensioned part of the thread is estimated maximum 1 cm. With a stronger thread, the ultimate elongation of the D-bolt at the wall surface (8 cm) would be significantly improved compared to the conventionally threaded rebar bolts. With such a deformation/load capacity, the bolt can provide a satisfying effect of rock reinforcement in largely deformed or rockburst-prone rock masses.

The bolt according to the invention has more than three anchors of length between 0.03 m and 0.02 m, each pair of anchors separated by segments which may vary correspondingly in length between about 0.3 m and 2 m in length, depending on the rock conditions and the thickness of the stem. The ratio of the length of the stem portions to the length of the anchors may vary between 5 to 1 and 40 to 1. The diameter of the rock bolt stem may be between 10 mm and 40 mm or more.

The rock bolt according to the invention is characteristic of a high capacity in both deformation- and load-bearing. Furthermore, the quality of bolt installation is reliable because of its multi-point anchoring mechanism. The bolt is particularly suit to civil and mining engineering which faces the problem of large rock deformation or rock burst. The bolt can provide a good reinforcement not only in the case of continuous rock deformation (in soft and weak rock masses), but also in the case of local opening of individual rock joints (in blocky rock masses). The opening displacement of a single rock joint will be constrained by the two anchors overriding the joint.

The anchors may be formed in several ways to provide some different forms: FIGS. 5*a, b, c, d*, and *e* illustrate embodiments of the anchors according to the invention. FIG. 5*a* illustrates an embodiment of the anchor in which a short portion of the stem has been flattened to provide a widened, integrated anchor having two lobes in the cross-section and tapering off toward either transition to the stem portions. The flattening may take place under slight longitudinal simultaneous upsetting so as for providing a yield strength of said anchors higher than the yield strength of the adjacent stem portions. FIG. 5*b* illustrates an embodiment of the anchor in which a short portion of the stem has been shortened by longitudinal upsetting. FIG. 5*c* is an illustration of a three-lobed anchor that shows a certain tapering-off in the transition zone toward either end. FIG. 5*d* illustrates a rock bolt according to the invention having anchors with an eye-shaped aperture. The material cross-section area of the anchor over the aperture, perpendicular to the axis of the rock bolt, is at least as large as for the stem. FIG. 5*e* illustrates an embodiment of an anchor shaped with two ends separated by a neck having at least the thickness of the rod stem. The upsetting is similar to the upsetting of FIG. 5*b*. In this embodiment the anchor may further be formed having three lobes.

The invention provides a rock bolt with multiple straight stem portions each followed by a short anchor. This provides short, relatively rigid anchors and a high proportion of stem lengths with a high deformation capacity. Thus the rock bolt will be attached firmly to a multiplicity of spaced borehole wall locations along the rod and constrain rock deformation. The pre-tensioning feature may prevent or delay initial crack formation and may also provide an earlier constraining of the rock mantle. The rock bolt according to the invention will be useful for constraining rock deformation both due to long-term deformation and rock burst

REFERENCES

Björnfot F. and Stephansson 0.1984. Mechanics of grouted rock bolts—field testing in hard rock mining. *Report BeFo* 53:1/84, Swedish Rock Engineering Research Foundation.

Li, C. C. 2006a. A practical problem with threaded rebar bolts in reinforcing largely deformed rock masses. *Rock Mech Rock Engng*. ISSN 0723-2632. (in press) Available online Li, C. C. 2006b. Rock support design based on the concept of pressure arch. Int. *J. Rock Mech. Min. Sci.* 43(7), 1083-1090.

Li, C. C. and Marklund, P.-I. 2004. Field tests of the cone bolt in the Boliden mines. Bergmekanikkdagen 2004, Oslo, 35.1-12. ISBN 82 91341 85 0.

Li, C. and Stillborg, B. 1999. Analytical models for rock bolts. *Int. J. Rock Mech. Min. Sci.* 36(8), 1013-1029. ISSN 1365-1609.

Stillborg B., *Professional Users Handbook for Rock Bolting*. Trans Tech Publications (2nd edition) (1994).

Sun, X. 1984. Grouted rock bolt used in underground engineering in soft surrounding rock or in highly stressed regions. *Proc. of Int. Symp. on Rock Bolting* (edited by O Stephansson), A. A. Balkema, Rotterdam. 93-99

The invention claimed is:

1. A rock bolt for being grouted in a borehole in a rock, said rock bolt comprising:

an elongate cylindrical solid stem with a threaded portion at a borehole surface portion of said stem, said threaded portion provided with one or more nuts and one or more washers, sheaves or face plates arranged for pre-tensioning the rock bolt in the borehole;

said stem comprising three or more lengths of stem portions, each of said three or more lengths of stem portions being followed by an integral anchor, each of said integral anchors having a length shorter than a length of each of said three or more stem portions, each of said integral anchors being separated from each other along a length of said stem;

said anchors for being locally anchored relative to corresponding local borehole wall portions for taking up load arising due to rock deformation; and said three or more stem portions having a smooth surface for slipping relative to the borehole or grout within the borehole, so that each of said three or more stem portions constrains local rock deformation through elongation of said three or more stem portions between adjacent pairs of said integral anchors.

2. The rock bolt of claim 1, wherein a ratio of a length of said three or more stem portions to a length of said integral anchors is between 5 to 1 and 40 to 1.

3. The rock bolt of claim 1, wherein said anchor spacing, is 0.55 m, and said anchor length is 0.05 m.

4. The rock bolt of claim 1, wherein said separations of said anchors are of the same lengths.

5. The rock bolt of claim 1, wherein said stem with integral anchors is made from steel.

6. The rock bolt of claim 1, wherein said one or more stem portions are arranged for having a higher deformation capacity per unit length as compared to said integral anchors.

7. The rock bolt of claim 1, wherein said integral anchors are hardened.

8. The rock bolt of claim 1, wherein a first yield strength of said integral anchors is higher than a second yield strength of said one or more stem portions.

9. The rock bolt of claim 1, wherein said bolt is mechanically polished or electropolished.

10. The rock bolt of claim 1, wherein said one or more stem portions are provided with a slip layer.

11. The rock bolt of claim 10, wherein said slip layer is wax or paint.

12. The rock bolt of claim 1, wherein said one or more stem portions are surface treated to avoid binding to hardened grout within the borehole.

13. The rock bolt of claim 12, wherein said surface treatment is a chemical treatment performed by adding a metal oxide layer on said stem.

14. The rock bolt of claim 1, wherein said anchors are tapered off to dissipate energy by displacing and deforming adjacent grout in the borehole when loaded beyond a retention capacity of said anchors in the grout.

15. The rock bolt of claim 1, wherein said threads have an effective diameter equal to or larger than an effective diameter of said stem.

16. The rock bolt of claim 1, wherein said threaded portion is hardened.

17. The rock bolt of claim 1, wherein a bottomhole end portion of said stem is provided with an end mixer.

18. The rock bolt of claim 17, wherein said end mixer is constituted by an anchor.

19. The rock bolt of claim 1, wherein a ratio of a length of said one or more stem portions to a length of said integral anchors is 10 to 1.

* * * * *